US011982183B2

(12) United States Patent
Jones et al.

(10) Patent No.: US 11,982,183 B2
(45) Date of Patent: May 14, 2024

(54) REMEDIATION OF A FORMATION UTILIZING AN ASPHALTENE ONSET PRESSURE MAP

(71) Applicant: Halliburton Energy Services, Inc., Houston, TX (US)

(72) Inventors: Christopher Michael Jones, Houston, TX (US); Rohin Naveena-Chandran, Houston, TX (US); Anthony Herman VanZuilekom, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 151 days.

(21) Appl. No.: 17/888,680

(22) Filed: Aug. 16, 2022

(65) Prior Publication Data

US 2023/0058017 A1 Feb. 23, 2023

Related U.S. Application Data

(60) Provisional application No. 63/234,046, filed on Aug. 17, 2021.

(51) Int. Cl.
*E21B 49/08* (2006.01)
*E21B 49/10* (2006.01)

(52) U.S. Cl.
CPC ..... *E21B 49/0875* (2020.05); *E21B 49/10* (2013.01)

(58) Field of Classification Search
CPC ..... E21B 49/0875; E21B 49/10
See application file for complete search history.

(56) References Cited

U.S. PATENT DOCUMENTS

| | | | | |
|---|---|---|---|---|
| 9,023,280 | B2 * | 5/2015 | Abad | E21B 49/08 73/152.55 |
| 2010/0154529 | A1 | 6/2010 | Terabayashi et al. | |
| 2011/0048700 | A1 | 3/2011 | van Zuilekom et al. | |
| 2012/0084021 | A1 | 4/2012 | Jones et al. | |
| 2013/0199286 | A1 | 8/2013 | Gao et al. | |
| 2013/0311099 | A1 | 11/2013 | Eyuboglu et al. | |
| 2014/0096957 | A1 | 4/2014 | van Zuilekom et al. | |
| 2014/0332280 | A1 | 11/2014 | van Zuilekom et al. | |
| 2015/0068734 | A1 | 3/2015 | Smits | |
| 2016/0237816 | A1 | 8/2016 | Perkins et al. | |

(Continued)

FOREIGN PATENT DOCUMENTS

EP 3032026 6/2016

OTHER PUBLICATIONS

U.S. Appl. No. 17/863,041 dated Jul. 12, 2022.

(Continued)

*Primary Examiner* — Kristina M Deherrera
*Assistant Examiner* — Jean F Morello
(74) *Attorney, Agent, or Firm* — John Wustenberg; C. Tumey Law Group PLLC

(57) ABSTRACT

A downhole fluid sampling tool comprising one or more probes configured to take at least one fluid sample from the wellbore and perform a Saturates, Aromatics, Resins, Asphaltenes (SARA) analysis on the at least one fluid sample. Additionally, the downhole fluid sampling tool comprises an information handling system for developing a first remediation operation based at least in part on the first SARA analysis and performing the first remediation operation on the first fluid sample to form a first remediated fluid sample.

20 Claims, 9 Drawing Sheets

(56) References Cited

U.S. PATENT DOCUMENTS

| | | | | |
|---|---|---|---|---|
| 2017/0198575 | A1* | 7/2017 | Sandor | E21B 47/12 |
| 2018/0024084 | A1* | 1/2018 | Hascakir | G01N 27/221 324/686 |
| 2018/0164273 | A1* | 6/2018 | Sieben | G01N 1/38 |
| 2019/0017377 | A1 | 1/2019 | He et al. | |
| 2019/0100995 | A1 | 4/2019 | He et al. | |
| 2020/0157937 | A1 | 5/2020 | Jones et al. | |
| 2020/0240264 | A1 | 7/2020 | He et al. | |
| 2020/0284140 | A1 | 9/2020 | Jones et al. | |
| 2020/0355072 | A1 | 11/2020 | Mansour et al. | |
| 2020/0378250 | A1 | 12/2020 | Olapade et al. | |
| 2020/0400017 | A1 | 12/2020 | Olapade et al. | |
| 2020/0400858 | A1 | 12/2020 | Olapade et al. | |
| 2021/0047924 | A1 | 2/2021 | Kallehbasti et al. | |
| 2021/0054737 | A1 | 2/2021 | Dai et al. | |
| 2021/0054738 | A1 | 2/2021 | Dai et al. | |
| 2021/0110246 | A1 | 4/2021 | Chen et al. | |
| 2021/0131283 | A1 | 5/2021 | Jones et al. | |
| 2021/0131951 | A1 | 5/2021 | Dai et al. | |
| 2021/0215033 | A1 | 7/2021 | Jones et al. | |
| 2021/0231001 | A1 | 7/2021 | Jones et al. | |
| 2021/0238999 | A1 | 8/2021 | Naveena-Chandran et al. | |
| 2021/0239000 | A1 | 8/2021 | Olapade et al. | |

OTHER PUBLICATIONS

U.S. Appl. No. 17/859,848 dated Jul. 7, 2022.
U.S. Appl. No. 17/589,336 dated Jan. 31, 2022.
International Search Report and Written Opinion for Application No. PCT/US2022/040521, dated Nov. 30, 2022.

* cited by examiner $P > P_{UAOP}$ $P = P_{UAOP}$
$P < P_{ARFO}$ $P = P_{ARFO}$
$P < P_{BP}$ $P = P_{BP}$
$P < P_{LAOP}$ $P_{BP} < P < P_{LOAP}$

REMEDIATION OF A FORMATION UTILIZING AN ASPHALTENE ONSET PRESSURE MAP

BACKGROUND

Wells may be drilled at various depths to access and produce oil, gas, minerals, and other naturally-occurring deposits from subterranean geological formations. The drilling of a well is typically accomplished with a drill bit that is rotated within the well to advance the well by removing topsoil, sand, clay, limestone, calcites, dolomites, or other materials. During or after drilling operations, sampling operations may be performed to collect a representative sample of formation or reservoir fluids (e.g., hydrocarbons) to further evaluate drilling operations and production potential, or to detect the presence of certain gases or other materials in the formation that may affect well performance.

The ability of reservoir fluid to flow freely to the surface is a constant challenge that affects the viability of an asset in all oil producing wellbore. The prevailing issue in the industry is asphaltenes. Asphaltenes are found in reservoir fluids and may fall out of solution due to a change in temperature or pressure as the reservoir fluid ascends to the surface. A proper understanding of asphaltene deposition lends itself to reliable completions planning, and timely remediation efforts. This ultimately dictates the production life of the reservoir. Traditionally, identifying asphaltenes from a wellbore fluid is performed in a laboratory. Therefore, there is a limitation to the effectiveness of determining asphaltene properties from the speed and cost at which they are determined. Currently, technology is not able to identify asphaltenes from a wellbore fluid sample during downhole operations.

BRIEF DESCRIPTION OF THE DRAWINGS

These drawings illustrate certain aspects of some examples of the present disclosure and should not be used to limit or define the disclosure.

DETAILED DESCRIPTION

The present disclosure relates to subterranean operations and, more particularly, embodiments disclosed herein provide methods and systems for identifying asphaltenes in a wellbore fluid sample downhole. This may allow for the construction of an asphaltene onset pressure (AOP) map. An AOP map may allow for and aid in determining reservoir simulation and production simulation at the well site without going to a laboratory. An AOP map may be determined from a Saturates, Aromatics, Resins, Asphaltenes (SARA) analysis downhole. Additionally, a remediation operation may be performed in a single zone for treatment of wellbores which enhances the ability of reservoir fluid to flow freely to the surface.

The fluid sampling tools, systems and methods described herein may be used with any of the various techniques employed for evaluating a well, including without limitation wireline formation testing (WFT), measurement while drilling (MWD), and logging while drilling (LWD). The various tools and sampling units described herein may be delivered downhole as part of a wireline-delivered downhole assembly or as a part of a drill string. It should also be apparent that given the benefit of this disclosure, the apparatuses and methods described herein have applications in downhole operations other than drilling and may also be used after a well is completed.

Figure 1:
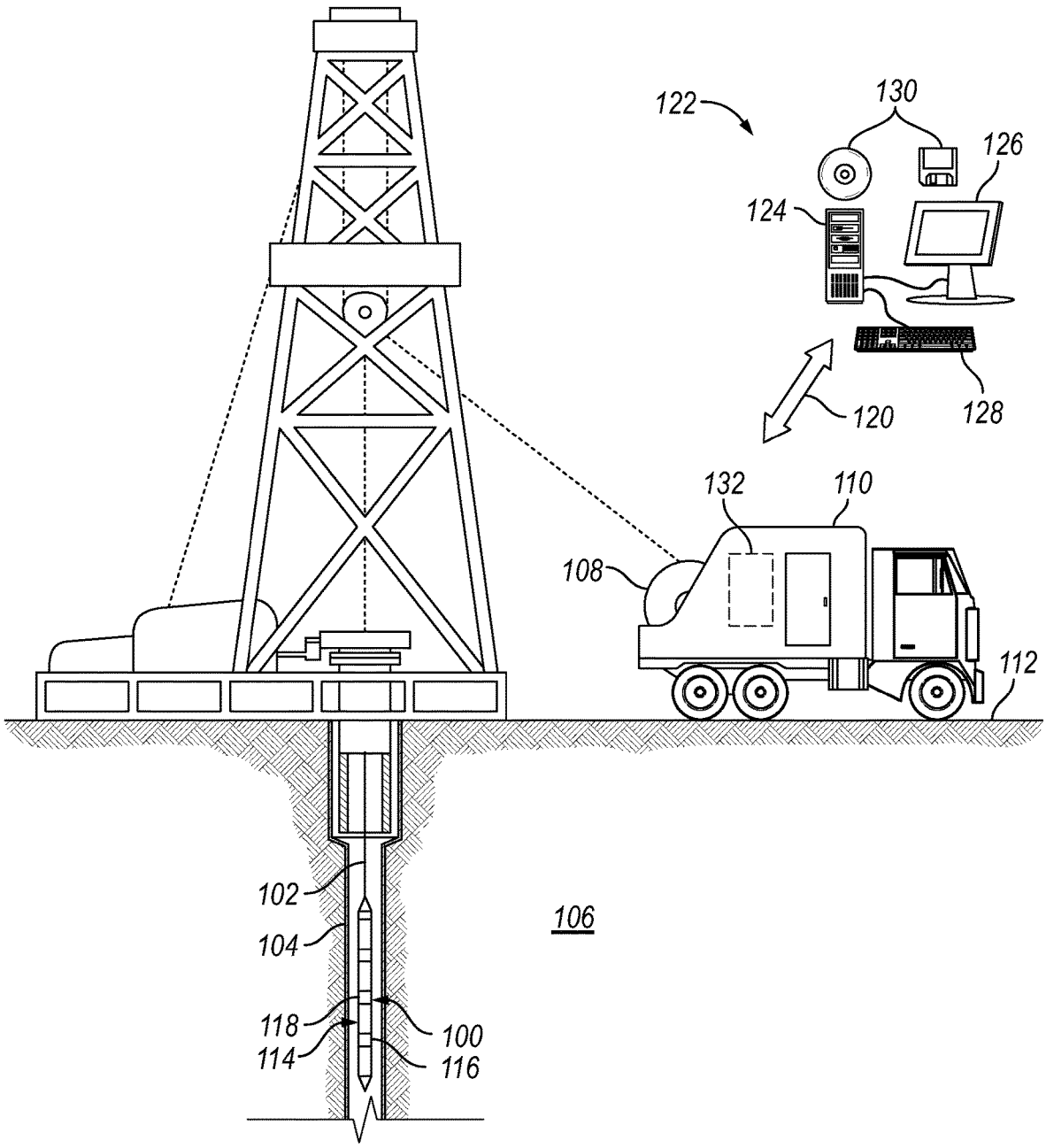
FIG. 1 illustrates a schematic view of a well in which an example embodiment of a fluid sample system is deployed.

FIG. 1 is a schematic diagram of downhole fluid sampling tool 100 on a conveyance 102. As illustrated, wellbore 104 may extend through subterranean formation 106. In examples, reservoir fluid may be contaminated with well fluid (e.g., drilling fluid) from wellbore 104. As described herein, the fluid sample may be analyzed to determine fluid contamination and other fluid properties of the reservoir fluid. As illustrated, a wellbore 104 may extend through subterranean formation 106. While the wellbore 104 is shown extending generally vertically into the subterranean formation 106, the principles described herein are also applicable to wellbores that extend at an angle through the subterranean formation 106, such as horizontal and slanted wellbores. For example, although FIG. 1 shows a vertical or low inclination angle well, high inclination angle or horizontal placement of the well and equipment is also possible. It should further be noted that while FIG. 1 generally depicts a land-based operation, those skilled in the art will readily recognize that the principles described herein are equally applicable to subsea operations that employ floating or sea-based platforms and rigs, without departing from the scope of the disclosure.

As illustrated, a hoist 108 may be used to run downhole fluid sampling tool 100 into wellbore 104. Hoist 108 may be disposed on a vehicle 110. Hoist 108 may be used, for example, to raise and lower conveyance 102 in wellbore 104. While hoist 108 is shown on vehicle 110, it should be understood that conveyance 102 may alternatively be disposed from a hoist 108 that is installed at surface 112 instead of being located on vehicle 110. Downhole fluid sampling tool 100 may be suspended in wellbore 104 on conveyance 102. Other conveyance types may be used for conveying downhole fluid sampling tool 100 into wellbore 104, including coiled tubing and wired drill pipe, for example. Downhole fluid sampling tool 100 may comprise a tool body 114, which may be elongated as shown on FIG. 1. Tool body 114 may be any suitable material, including without limitation titanium, stainless steel, alloys, plastic, combinations thereof, and the like. Downhole fluid sampling tool 100 may further include one or more sensors 116 for measuring properties of the fluid sample, reservoir fluid, wellbore 104, subterranean formation 106, or the like. In examples, downhole fluid sampling tool 100 may also include a fluid analysis module 118, which may be operable to process information regarding fluid sample, as described below. The downhole fluid sampling tool 100 may be used to collect fluid samples from subterranean formation 106 and may obtain and separately store different fluid samples from subterranean formation 106.

In examples, fluid analysis module 118 may comprise at least one a sensor that may continuously monitor a fluid such as a reservoir fluid, formation fluid, wellbore fluid, or formation nonnative fluids such as drilling fluid filtrate. Such monitoring may take place in a fluid flow line or a formation tester probe such as a pad or packer or may be able to make measurements investigating the formation including measurements into the formation. Such sensors include optical sensors, acoustic sensors, electromagnetic sensors, conductivity sensors, resistivity sensors, selective electrodes, density sensors, mass sensors, thermal sensors, chromatography sensors, viscosity sensors, bubble point sensors, fluid compressibility sensors, flow rate sensors, pressure sensors, nuclear magnetic resonance (NMR) sensors. Sensors may measure a contrast between drilling fluid filtrate properties and formation fluid properties. Fluid analysis module 118 may be operable to derive properties and characterize the fluid sample. By way of example, fluid analysis module 118 may measure absorption, transmittance, or reflectance spectra and translate such measurements into component concentrations of the fluid sample, which may be lumped component concentrations, as described above. The fluid analysis module 118 may also measure gas-to-oil ratio, fluid composition, water cut, live fluid density, live fluid viscosity, formation pressure, and formation temperature and fluid composition. Fluid analysis module 118 may also be operable to determine fluid contamination of the fluid sample and may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. The absorption, transmittance, or reflectance spectra absorption, transmittance, or reflectance spectra may be measured with sensors 116 by way of standard operations. For example, fluid analysis module 118 may include random access memory (RAM), one or more processing units, such as a central processing unit (CPU), or hardware or software control logic, ROM, and/or other types of nonvolatile memory. Fluid analysis module 118 may be communicatively coupled via communication link 120 with information handling system 122.

Any suitable technique may be used for transmitting signals from the downhole fluid sampling tool 100 to the surface 112. As illustrated, a communication link 120 (which may be wired or wireless, for example) may be provided that may transmit data from downhole fluid sampling tool 100 to an information handling system 122 at surface 112. Information handling system 122 may include a processing unit 124, a monitor 126, an input device 128 (e.g., keyboard, mouse, etc.), and/or computer media 130 (e.g., optical disks, magnetic disks) that can store code representative of the methods described herein. Information handling system 122 may act as a data acquisition system and possibly a data processing system that analyzes information from downhole fluid sampling tool 100. For example, information handling system 122 may process the information from downhole fluid sampling tool 100 for determination of fluid contamination. The information handling system 122 may also determine additional properties of the fluid sample (or reservoir fluid), such as component concentrations, pressure-volume-temperature properties (e.g., bubble point, phase envelop prediction, etc.) based on the fluid characterization. This processing may occur at surface 112 in real-time. Alternatively, the processing may occur downhole hole or at surface 112 or another location after recovery of downhole fluid sampling tool 100 from wellbore 104. Alternatively, the processing may be performed by an information handling system in wellbore 104, such as fluid analysis module 118. The resultant fluid contamination and fluid properties may then be transmitted to surface 112, for example, in real-time.

Figure 2:
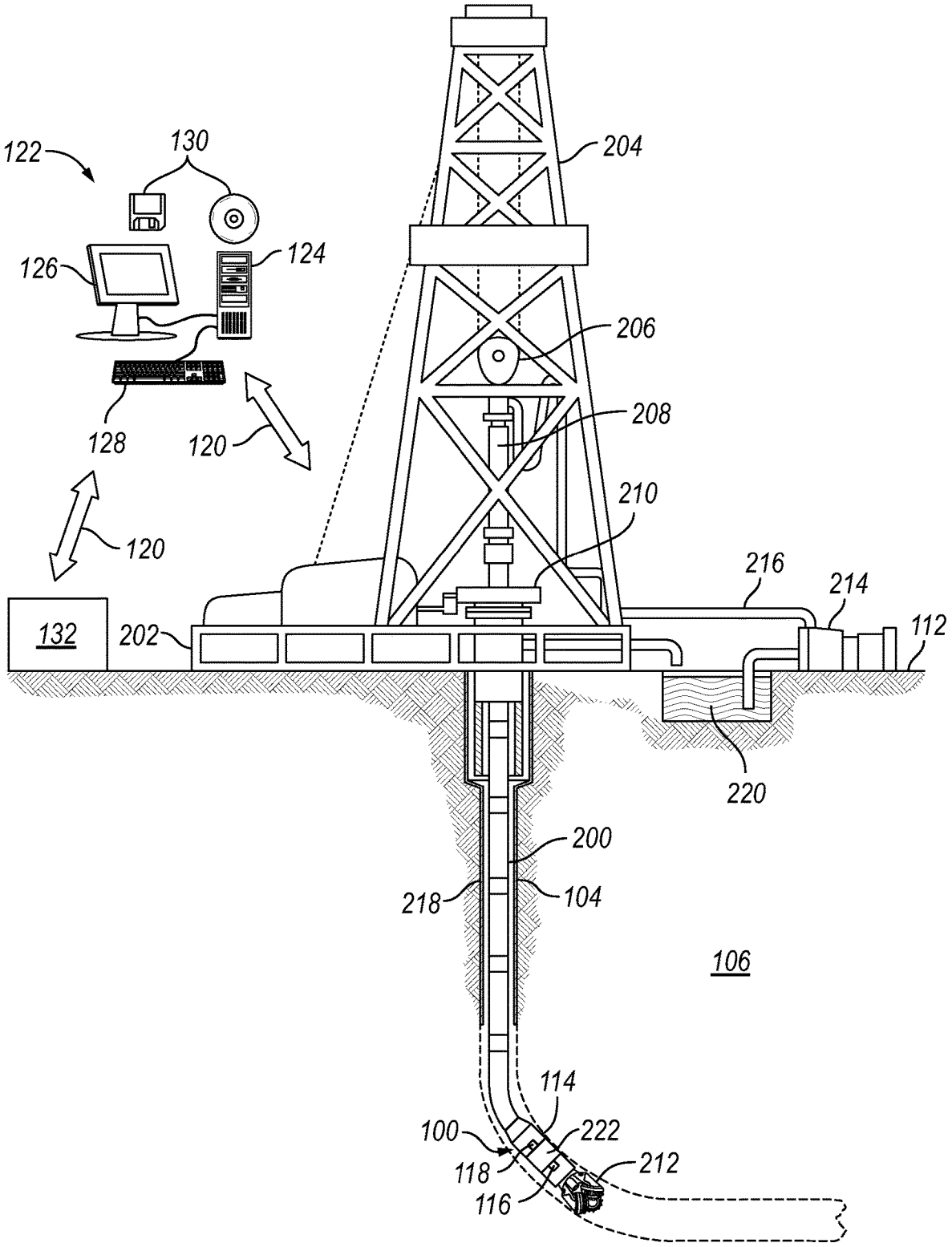
FIG. 2 illustrates a schematic view of another well in which an example embodiment of a fluid sample system is deployed.

Referring now to FIG. 2, a schematic diagram of downhole fluid sampling tool 100 disposed on a drill string 200 in a drilling operation. Downhole fluid sampling tool 100 may be used to obtain a fluid sample, for example, a fluid sample of a reservoir fluid from subterranean formation 106. The reservoir fluid may be contaminated with well fluid (e.g., drilling fluid) from wellbore 104. As described herein, the fluid sample may be analyzed to determine fluid contamination and other fluid properties of the reservoir fluid. As illustrated, a wellbore 104 may extend through subterranean formation 106. While the wellbore 104 is shown extending generally vertically into the subterranean formation 106, the principles described herein are also applicable to wellbores that extend at an angle through the subterranean formation 106, such as horizontal and slanted wellbores. For example, although FIG. 2 shows a vertical or low inclination angle well, high inclination angle or horizontal placement of the well and equipment is also possible. It should further be noted that while FIG. 2 generally depicts a land-based operation, those skilled in the art will readily recognize that the principles described herein are equally applicable to subsea operations that employ floating or sea-based platforms and rigs, without departing from the scope of the disclosure.

As illustrated, a drilling platform 202 may support a derrick 204 having a traveling block 206 for raising and lowering drill string 200. Drill string 200 may include, but is not limited to, drill pipe and coiled tubing, as generally known to those skilled in the art. A kelly 208 may support drill string 200 as it may be lowered through a rotary table 210. A drill bit 212 may be attached to the distal end of drill string 200 and may be driven either by a downhole motor and/or via rotation of drill string 200 from the surface 112. Without limitation, drill bit 212 may include, roller cone bits, PDC bits, natural diamond bits, any hole openers, reamers, coring bits, and the like. As drill bit 212 rotates, it may create and extend wellbore 104 that penetrates various subterranean formations 106. A pump 214 may circulate drilling fluid through a feed pipe 216 to kelly 208, downhole through interior of drill string 200, through orifices in drill bit 212, back to surface 112 via annulus 218 surrounding drill string 200, and into a retention pit 220.

Drill bit 212 may be just one piece of a downhole assembly that may include one or more drill collars 222 and downhole fluid sampling tool 100. Downhole fluid sampling tool 100, which may be built into the drill collars 222 may gather measurements and fluid samples as described herein. One or more of the drill collars 222 may form a tool body 114, which may be elongated as shown on FIG. 2. Tool body 114 may be any suitable material, including without limitation titanium, stainless steel, alloys, plastic, combinations thereof, and the like. Downhole fluid sampling tool 100 may be similar in configuration and operation to downhole fluid sampling tool 100 shown on FIG. 1 except that FIG. 2 shows downhole fluid sampling tool 100 disposed on drill string 200. Alternatively, the sampling tool may be lowered into the wellbore after drilling operations on a wireline.

Downhole fluid sampling tool 100 may further include one or more sensors 116 for measuring properties of the fluid sample reservoir fluid, wellbore 104, subterranean formation 106, or the like. The one or more sensors 116 may be disposed within fluid analysis module 118. In examples, more than one fluid analysis module may be disposed on drill string 200. The properties of the fluid are measured as the fluid passes from the formation through the tool and into either the wellbore or a sample container. As fluid is flushed in the near wellbore region by the mechanical pump, the fluid that passes through the tool generally reduces in drilling fluid filtrate content, and generally increases in formation fluid content. The downhole fluid sampling tool 100 may be used to collect a fluid sample from subterranean formation 106 when the filtrate content has been determined to be sufficiently low. Sufficiently low depends on the purpose of sampling. For some laboratory testing below 10% drilling fluid contamination is sufficiently low, and for other testing below 1% drilling fluid filtrate contamination is sufficiently low. Sufficiently low also depends on the nature of the formation fluid such that lower requirements are generally needed, the lighter the oil as designated with either a higher GOR or a higher API gravity. Sufficiently low also depends on the rate of cleanup in a cost benefit analysis since longer pumpout times may be utilized to incrementally reduce the contamination levels may have prohibitively large costs. As previously described, the fluid sample may comprise a reservoir fluid, which may be contaminated with a drilling fluid or drilling fluid filtrate. Downhole fluid sampling tool 100 may obtain and separately store different fluid samples from subterranean formation 106 with fluid analysis module 118. Fluid analysis module 118 may operate and function in the same manner as described above. However, storing of the fluid samples in the downhole fluid sampling tool 100 may be based on the determination of the fluid contamination. For example, if the fluid contamination exceeds a tolerance, then the fluid sample may not be stored. If the fluid contamination is within a tolerance, then the fluid sample may be stored in the downhole fluid sampling tool 100. In examples, contamination may be defined within fluid analysis module 118.

As previously described, information from downhole fluid sampling tool 100 may be transmitted to an information handling system 122, which may be located at surface 112. As illustrated, communication link 120 (which may be wired or wireless, for example) may be provided that may transmit data from downhole fluid sampling tool 100 to an information handling system 122 at surface 112. Information handling system 122 may include a processing unit 124, a monitor 126, an input device 128 (e.g., keyboard, mouse, etc.), and/or computer media 130 (e.g., optical disks, magnetic disks) that may store code representative of the methods described herein. In addition to, or in place of processing at surface 112, processing may occur downhole (e.g., fluid analysis module 118). In examples, information handling system 122 may perform computations to estimate asphaltenes within a fluid sample.

Figure 3:
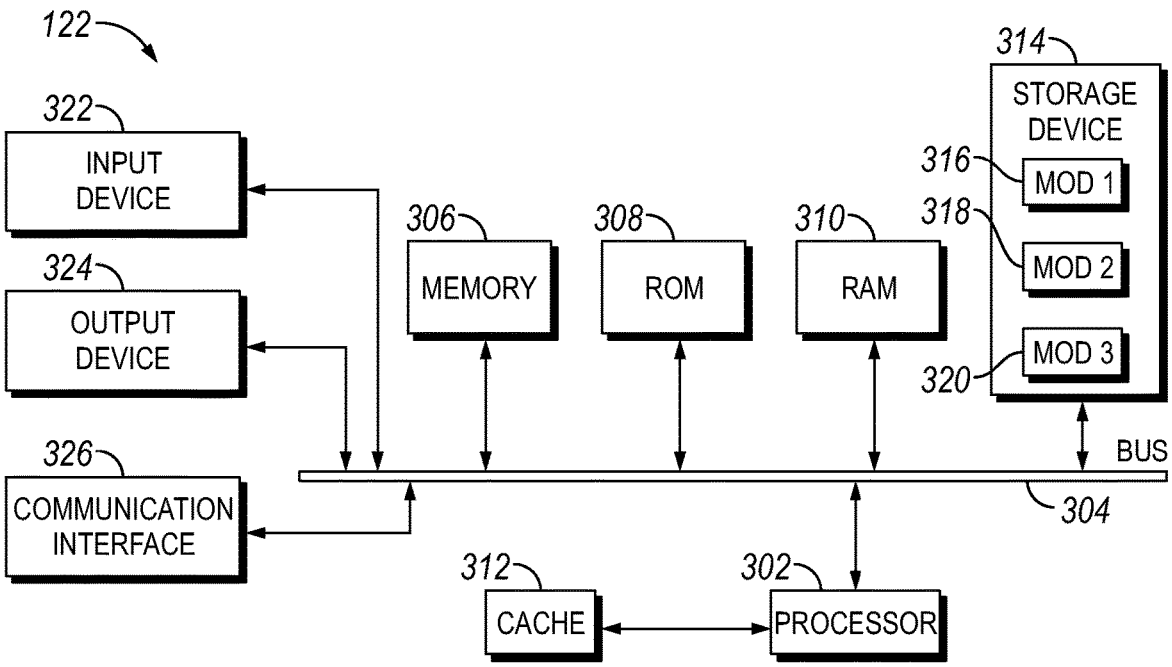
FIG. 3 illustrates a schematic view of a chipset in an information handling system.

FIG. 3 illustrates an example information handling system 122 which may be employed to perform various steps, methods, and techniques disclosed herein. Persons of ordinary skill in the art will readily appreciate that other system examples are possible. As illustrated, information handling system 122 includes a processing unit (CPU or processor) 302 and a system bus 304 that couples various system components including system memory 306 such as read only memory (ROM) 308 and random-access memory (RAM) 310 to processor 302. Processors disclosed herein may all be forms of this processor 302. Information handling system 122 may include a cache 312 of high-speed memory connected directly with, in close proximity to, or integrated as part of processor 302. Information handling system 122 copies data from memory 306 and/or storage device 314 to cache 312 for quick access by processor 302. In this way, cache 312 provides a performance boost that avoids processor 302 delays while waiting for data. These and other modules may control or be configured to control processor 302 to perform various operations or actions. Other system memory 306 may be available for use as well. Memory 306 may include multiple different types of memory with different performance characteristics. It may be appreciated that the disclosure may operate on information handling system 122 with more than one processor 302 or on a group or cluster of computing devices networked together to provide greater processing capability. Processor 302 may include any general purpose processor and a hardware module or software module, such as first module 316, second module 318, and third module 320 stored in storage device 314, configured to control processor 302 as well as a special-purpose processor where software instructions are incorporated into processor 302. Processor 302 may be a self-contained computing system, containing multiple cores or processors, a bus, memory controller, cache, etc. A multi-core processor may be symmetric or asymmetric. Processor 302 may include multiple processors, such as a system having multiple, physically separate processors in different sockets, or a system having multiple processor cores on a single physical chip. Similarly, processor 302 may include multiple distributed processors located in multiple separate computing devices but working together such as via a communications network. Multiple processors or processor cores may share resources such as memory 306 or cache 312 or may operate using independent resources. Processor 302 may include one or more state machines, an application specific integrated circuit (ASIC), or a programmable gate array (PGA) including a field PGA (FPGA).

Each individual component discussed above may be coupled to system bus 304, which may connect each and every individual component to each other. System bus 304 may be any of several types of bus structures including a memory bus or memory controller, a peripheral bus, and a local bus using any of a variety of bus architectures. A basic input/output (BIOS) stored in ROM 308 or the like, may provide the basic routine that helps to transfer information between elements within information handling system 122, such as during start-up. Information handling system 122 further includes storage devices 314 or computer-readable storage media such as a hard disk drive, a magnetic disk drive, an optical disk drive, tape drive, solid-state drive, RAM drive, removable storage devices, a redundant array of inexpensive disks (RAID), hybrid storage device, or the like. Storage device 314 may include software modules 316, 318, and 320 for controlling processor 302. Information handling system 122 may include other hardware or software modules. Storage device 314 is connected to the system bus 304 by a drive interface. The drives and the associated computer-readable storage devices provide nonvolatile storage of computer-readable instructions, data structures, program modules and other data for information handling system 122. In one aspect, a hardware module that performs a particular function includes the software component stored in a tangible computer-readable storage device in connection with the necessary hardware components, such as processor 302, system bus 304, and so forth, to carry out a particular function. In another aspect, the system may use a processor and computer-readable storage device to store instructions which, when executed by the processor, cause the processor to perform operations, a method or other specific actions. The basic components and appropriate variations may be modified depending on the type of device, such as whether information handling system 122 is a small, handheld computing device, a desktop computer, or a computer server. When processor 302 executes instructions to perform "operations", processor 302 may perform the operations directly and/or facilitate, direct, or cooperate with another device or component to perform the operations.

As illustrated, information handling system 122 employs storage device 314, which may be a hard disk or other types of computer-readable storage devices which may store data that are accessible by a computer, such as magnetic cassettes, flash memory cards, digital versatile disks (DVDs), cartridges, random access memories (RAMs) 310, read only memory (ROM) 308, a cable containing a bit stream and the like, may also be used in the exemplary operating environment. Tangible computer-readable storage media, computer-readable storage devices, or computer-readable memory devices, expressly exclude media such as transitory waves, energy, carrier signals, electromagnetic waves, and signals per se.

To enable user interaction with information handling system 122, an input device 322 represents any number of input mechanisms, such as a microphone for speech, a touch-sensitive screen for gesture or graphical input, keyboard, mouse, motion input, speech and so forth. Additionally, input device 322 may take in data from one or more sensors 136, discussed above. An output device 324 may also be one or more of a number of output mechanisms known to those of skill in the art. In some instances, multimodal systems enable a user to provide multiple types of input to communicate with information handling system 122. Communications interface 326 generally governs and manages the user input and system output. There is no restriction on operating on any particular hardware arrangement and therefore the basic hardware depicted may easily be substituted for improved hardware or firmware arrangements as they are developed.

As illustrated, each individual component describe above is depicted and disclosed as individual functional blocks. The functions these blocks represent may be provided through the use of either shared or dedicated hardware, including, but not limited to, hardware capable of executing software and hardware, such as a processor 302, that is purpose-built to operate as an equivalent to software executing on a general purpose processor. For example, the functions of one or more processors presented in FIG. 3 may be provided by a single shared processor or multiple processors. (Use of the term "processor" should not be construed to refer exclusively to hardware capable of executing software.) Illustrative embodiments may include microprocessor and/or digital signal processor (DSP) hardware, read-only memory (ROM) 308 for storing software performing the operations described below, and random-access memory (RAM) 310 for storing results. Very large-scale integration (VLSI) hardware embodiments, as well as custom VLSI circuitry in combination with a general-purpose DSP circuit, may also be provided.

The logical operations of the various methods, described below, are implemented as: (1) a sequence of computer implemented steps, operations, or procedures running on a programmable circuit within a general use computer, (2) a sequence of computer implemented steps, operations, or procedures running on a specific-use programmable circuit; and/or (3) interconnected machine modules or program engines within the programmable circuits. Information handling system 122 may practice all or part of the recited methods, may be a part of the recited systems, and/or may operate according to instructions in the recited tangible computer-readable storage devices. Such logical operations may be implemented as modules configured to control processor 302 to perform particular functions according to the programming of software modules 316, 318, and 320.

In examples, one or more parts of the example information handling system 122, up to and including the entire information handling system 122, may be virtualized. For example, a virtual processor may be a software object that executes according to a particular instruction set, even when a physical processor of the same type as the virtual processor is unavailable. A virtualization layer or a virtual "host" may enable virtualized components of one or more different computing devices or device types by translating virtualized operations to actual operations. Ultimately however, virtualized hardware of every type is implemented or executed by some underlying physical hardware. Thus, a virtualization compute layer may operate on top of a physical compute layer. The virtualization compute layer may include one or more virtual machines, an overlay network, a hypervisor, virtual switching, and any other virtualization application.

Figure 4:
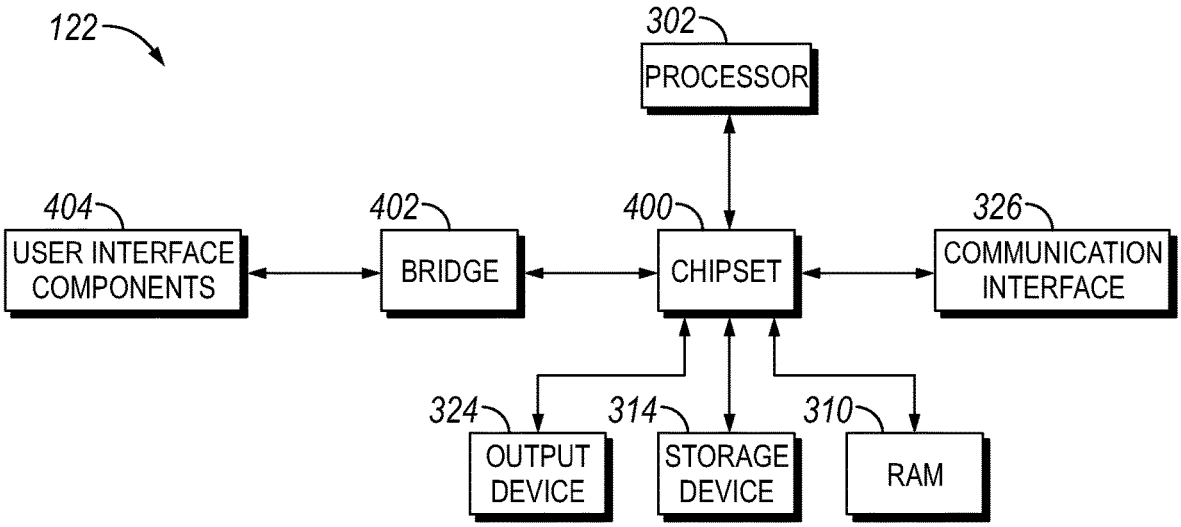
FIG. 4 illustrates the chipset in communication with other components of the information handling system.

FIG. 4 illustrates an example information handling system 122 having a chipset architecture that may be used in executing the described method and generating and displaying a graphical user interface (GUI). Information handling system 122 is an example of computer hardware, software, and firmware that may be used to implement the disclosed technology. Information handling system 122 may include a processor 302, representative of any number of physically and/or logically distinct resources capable of executing software, firmware, and hardware configured to perform identified computations. Processor 302 may communicate with a chipset 400 that may control input to and output from processor 302. In this example, chipset 400 outputs information to output device 324, such as a display, and may read and write information to storage device 314, which may include, for example, magnetic media, and solid-state media. Chipset 400 may also read data from and write data to RAM 310. A bridge 402 for interfacing with a variety of user interface components 404 may be provided for interfacing with chipset 400. Such user interface components 404 may include a keyboard, a microphone, touch detection and processing circuitry, a pointing device, such as a mouse, and so on. In general, inputs to information handling system 122 may come from any of a variety of sources, machine generated and/or human generated.

Chipset 400 may also interface with one or more communication interfaces 326 that may have different physical interfaces. Such communication interfaces may include interfaces for wired and wireless local area networks, for broadband wireless networks, as well as personal area networks. Some applications of the methods for generating, displaying, and using the GUI disclosed herein may include receiving ordered datasets over the physical interface or be generated by the machine itself by processor 302 analyzing data stored in storage device 314 or RAM 310. Further, information handling system 122 receive inputs from a user via user interface components 404 and execute appropriate functions, such as browsing functions by interpreting these inputs using processor 302.

In examples, information handling system 122 may also include tangible and/or non-transitory computer-readable storage devices for carrying or having computer-executable instructions or data structures stored thereon. Such tangible computer-readable storage devices may be any available device that may be accessed by a general purpose or special purpose computer, including the functional design of any special purpose processor as described above. By way of example, and not limitation, such tangible computer-readable devices may include RAM, ROM, EEPROM, CD-ROM or other optical disk storage, magnetic disk storage or other magnetic storage devices, or any other device which may be used to carry or store desired program code in the form of computer-executable instructions, data structures, or processor chip design. When information or instructions are provided via a network, or another communications connection (either hardwired, wireless, or combination thereof), to a computer, the computer properly views the connection as a computer-readable medium. Thus, any such connection is properly termed a computer-readable medium. Combinations of the above should also be included within the scope of the computer-readable storage devices.

Computer-executable instructions include, for example, instructions and data which cause a general-purpose computer, special purpose computer, or special purpose processing device to perform a certain function or group of functions. Computer-executable instructions also include program modules that are executed by computers in stand-alone or network environments. Generally, program modules include routines, programs, components, data structures, objects, and the functions inherent in the design of special-purpose processors, etc. that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described in such steps.

In additional examples, methods may be practiced in network computing environments with many types of computer system configurations, including personal computers, hand-held devices, multi-processor systems, microprocessor-based or programmable consumer electronics, network PCs, minicomputers, mainframe computers, and the like. Examples may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices. During drilling operations information handling system 122 may process different types of the real time data which may be utilized to create an asphaltene onset pressure map (AOP).

Figure 5:
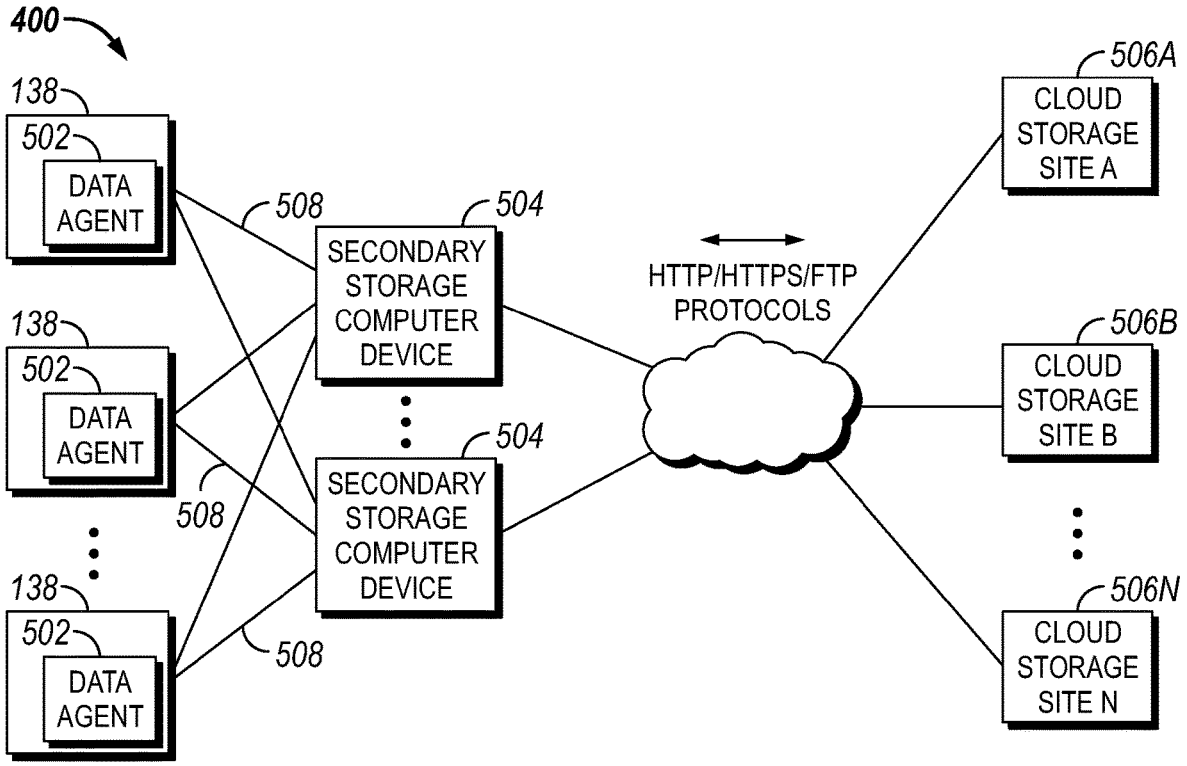
FIG. 5 illustrates a schematic view of a cloud based system.

FIG. 5 illustrates an example of one arrangement of resources in a computing network 500 that may employ the processes and techniques described herein, although many others are of course possible. As noted above, an information handling system 122, as part of their function, may utilize data, which includes files, directories, metadata (e.g., access control list (ACLS) creation/edit dates associated with the data, etc.), and other data objects. The data on the information handling system 122 is typically a primary copy (e.g., a production copy). During a copy, backup, archive or other storage operation, information handling system 122 may send a copy of some data objects (or some components thereof) to a secondary storage computing device 504 by utilizing one or more data agents 502.

A data agent 502 may be a desktop application, website application, or any software-based application that is run on information handling system 122. As illustrated, information handling system 122 may be disposed at any rig site (e.g., referring to FIG. 1) or repair and manufacturing center. Data agent 502 may communicate with a secondary storage computing device 504 using communication protocol 508 in a wired or wireless system. Communication protocol 508 may function and operate as an input to a website application. In the website application, field data related to pre- and post-operations, generated DTCs, notes, and the like may be uploaded. Additionally, information handling system 122 may utilize communication protocol 508 to access processed measurements, operations with similar DTCs, troubleshooting findings, historical run data, and/or the like. This information is accessed from secondary storage computing device 504 by data agent 502, which is loaded on information handling system 122.

Secondary storage computing device 504 may operate and function to create secondary copies of primary data objects (or some components thereof) in various cloud storage sites 506A-N. Additionally, secondary storage computing device 504 may run determinative algorithms on data uploaded from one or more information handling systems 122, discussed further below. Communications between the secondary storage computing devices 504 and cloud storage sites 506A-N may utilize REST protocols (Representational state transfer interfaces) that satisfy basic C/R/U/D semantics (Create/Read/Update/Delete semantics), or other hypertext transfer protocol ("HTTP")-based or file-transfer protocol ("FTP")-based protocols (e.g., Simple Object Access Protocol).

In conjunction with creating secondary copies in cloud storage sites 506A-N, the secondary storage computing device 504 may also perform local content indexing and/or local object-level, sub-object-level or block-level deduplication when performing storage operations involving various cloud storage sites 506A-N. Cloud storage sites 506A-N may further record and maintain DTC code logs for each downhole operation or run, map DTC codes, store repair and maintenance data, store operational data, and/or provide outputs from determinative algorithms that are fun at cloud storage sites 506A-N. This type of network may be utilized to an asphaltene onset pressure map (AOP).

Figure 6:
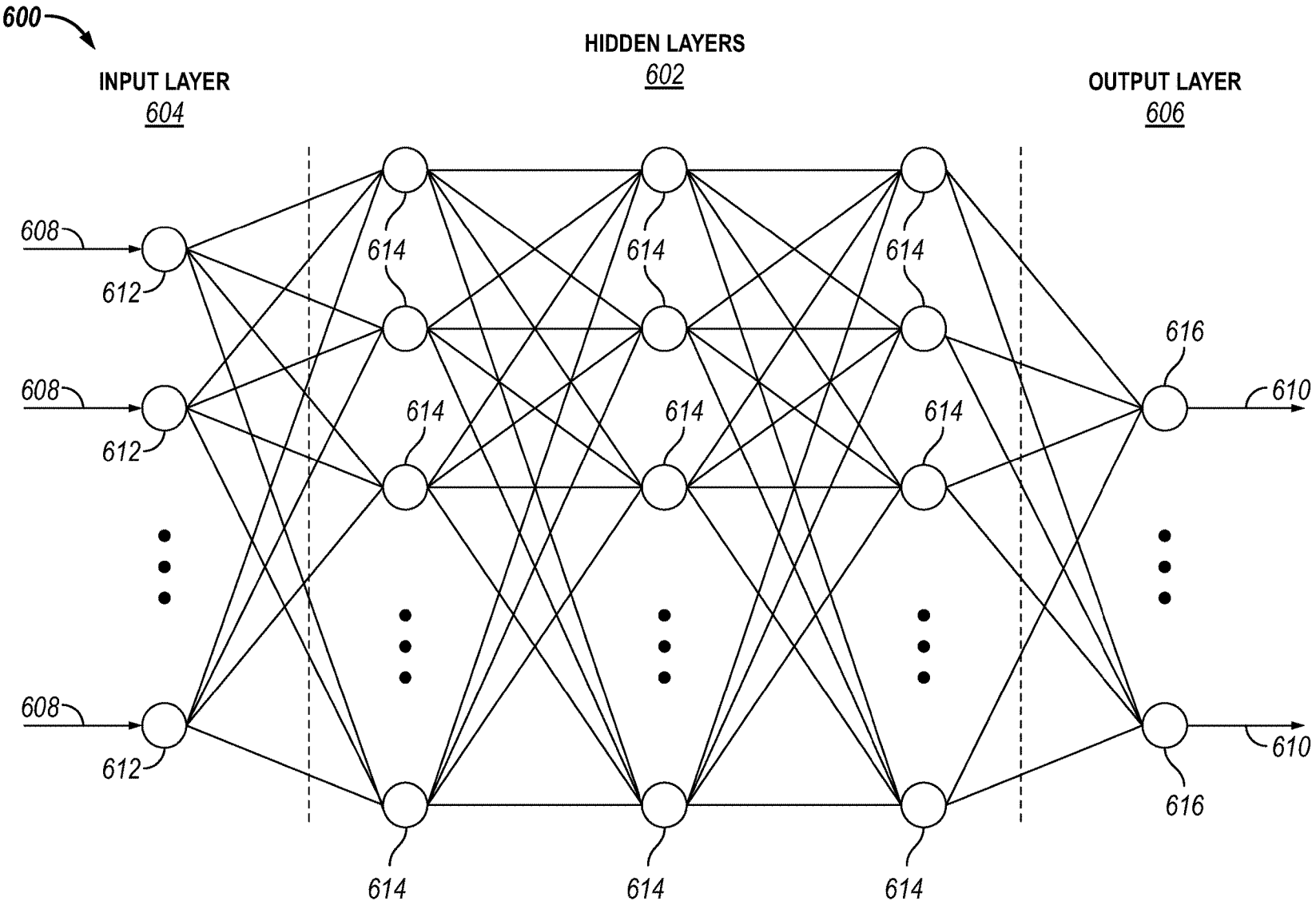
FIG. 6 illustrates a neural network.

FIG. 6 illustrates neural network (NN) 600. NN 600 may operate utilizing one or more information handling systems 122 (e.g., referring to FIGS. 1 and 2) on computing network 500. Although a NN is illustrated, multiple models may be used with input output structures. These models may include flexible empirical models such as NN, gaussian processing methods, kriging methods, evolutionary methods such as genetic algorithms, classification methods, clustering methods empirical methods, or physics based methods such as equations of state, thermodynamic models, geological, geochemistry, or chemistry models, or kinetic models or any combinations therein including recursive combinations of similar or dissimilar models and iterative model combinations. A NN 600 is an artificial neural network with one or more hidden layers 602 between input layer 604 and output layer 606. In examples, NN 600 may be software on a single information handling system 122. In other examples, NN 600 may software running on multiple information handling systems 122 connected wirelessly and/or by a hard wired connection in a network of multiple information handling systems 122. Herein, NN 600 may be applied in a wide array of implementations. For example, NN 600 may be modeled for forming an AOP map, reservoir simulation, production decisions, or single AOP determinations.

As such, input layer 604 may include any number of inputs 608. Inputs 608 may comprise properties of fluid and/or fluid formations such as physical properties (bulk or molecular) such as density, index of refraction, compressibility, bubble point, phase and/or other phase behavior properties measured by downhole fluid sampling tool 100. In examples, inputs may also include transport properties such as viscosity or thermal conductivity. Fluid analysis modules 118 may determine optical, chromatographic, mass spectrometry, density sensor, viscosity sensor, phase change apparatus compressibility sensor resistivity sensor, capacitance or dielectric sensor acoustic sensor, or combinations therein. Additionally, inputs 608 may also include chemical properties including composition i.e., hydrocarbon composition (methane, ethane propane, butane, pentane, hexane, higher hydrocarbons) and or chemical classes such as but not limited to Saturates, Aromatics, Resins or Asphaltenes chemical classes, and their respective concentrations of the various components, pH, eH, chemical potential, reactivity, fluid compatibility, and/or scaling potential. Fluid analysis modules 118 may determine optical, chromatographic, mass spectrometry, density sensor, viscosity sensor, phase change apparatus compressibility sensor resistivity sensor, capacitance or dielectric sensor acoustic sensor, or combinations therein. In other examples, inputs may include raw sensor measurements such as temperature, pressure, optical information, acoustic information, and/or electromagnetic information. Fluid analysis modules 118 may determine optical, chromatographic, mass spectrometry, density sensor, viscosity sensor, phase change apparatus compressibility sensor resistivity sensor, capacitance or dielectric sensor acoustic sensor, or combinations therein. In examples, output layer 606 may form outputs 606. Outputs 610 may comprise other unmeasured or less well measured physical or chemical properties, and/or correlated sensor measurements. For instance, outputs 610 may comprise scaling potential, or asphaltene onset pressure if not directly measured. Alternatively, the model may provide outputs 610 for enhanced resolution, precision or accuracy refinement of a measured property such as bubble point, or asphaltene onset pressure which may be included as an input 608 but refined as an enhanced measurement as an output 610 in output layer 606. Any of the inputs 608 or outputs 610 may be from the current well being evaluated or analogue wells which may be in the field, in the basis, or not so if other characteristics such as but not limited to formation type or formation fluid provide a basis for analogy. During operations, inputs 608 data are given to neurons 612 in input layer 604. Neurons 612, 614, and 616 are defined as individual or multiple information handling systems 122 connected in a network, which may compute information to make drilling, completion or production decisions such as but not limited how to drill the well, where to drill the well, how to complete a well, or where to complete a well, or how to produce a well, or where to produce a well. Any of computations may be from the current well being evaluated or analogue wells which may be in the field, in the basis, or not so if other characteristics such as but not limited to formation type or formation fluid provide a basis for analogy. The output from neurons 612 may be transferred to one or more neurons 614 within one or more hidden layers 602. Hidden layers 602 includes one or more neurons 614 connected in a network that further process information from neurons 612. The number of hidden layers 602 and neurons 612 in hidden layer 602 may be determined by personnel that designs NN 600. Hidden layers 602 is defined as a set of information handling system 122 assigned to specific processing. Hidden layers 602 spread computation to multiple neurons 612, which may allow for faster computing, processing, training, and learning by NN 600. Output layers 606 may combine the processing in hidden layers 602, using neurons 616, to form an asphaltene onset pressure (AOP). By any of the modeling methods, output layers 606, wherein other methods may use different layer or subfunction structuring, may be coordinated such that simultaneously an AOP may be provided for different outputs each corresponding to a different depths or lateral distance across a field or distance from an injecting well, temperature or other state condition comprising at least formation or concentration of materials. Multiple outputs may be coordinated wherein the multiple outputs are different but related parameters which may include but is not limited to asphaltene onset pressure, and asphaltene stability index, either static for a single state, or as a function independent variable such as but not limited to depth or lateral distance across a field or distance from an injecting well or of state variables such as but not limited to temperature.

Figure 7:
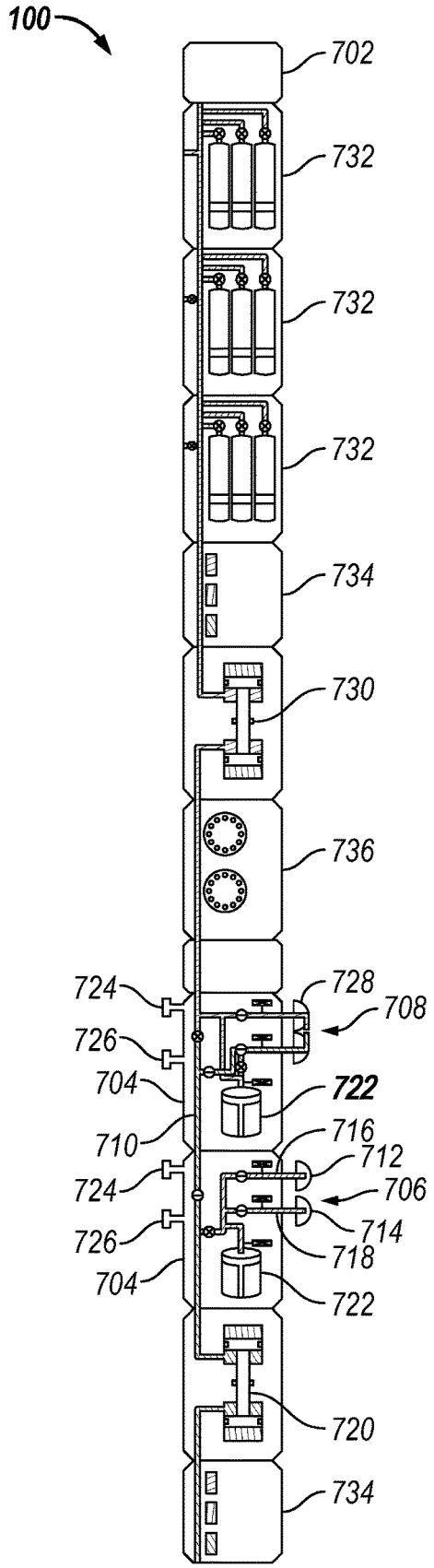
FIG. 7 illustrates a schematic view of an example embodiment of a fluid sampling tool.

FIG. 7 illustrates a schematic of downhole fluid sampling tool 100. As illustrated, downhole fluid sampling tool 100 includes a power telemetry section 702 through which downhole fluid sampling tool 100 may communicate with other actuators and sensors in a conveyance (e.g., conveyance 102 on FIG. 1 or drill string 200 on FIG. 2), the conveyance's communications system, such as information handling system 122 (e.g., referring to FIG. 1). In examples, power telemetry section 702 may also be a port through which the various actuators (e.g., valves) and sensors (e.g., temperature and pressure sensors) in downhole fluid sampling tool 100 may be controlled and monitored. In examples, power telemetry section 702 may comprise an additional information handling system 122 (not illustrated) that exercises the control and monitoring function. In one example, the control and monitoring function is performed by an information handling system 122 in another part of the drill string or downhole fluid sampling tool 100 (e.g., referring to FIG. 1) or by an information handling system at surface 112.

Information from downhole fluid sampling tool 100 may be gathered and/or processed by the information handling system 122 (e.g., referring to FIGS. 1 and 2). The processing may be performed real-time during data acquisition or after recovery of downhole fluid sampling tool 100. Processing may alternatively occur downhole or may occur both downhole and at surface. In some examples, signals recorded by downhole fluid sampling tool 100 may be conducted to information handling system by way of conveyance. Information handling system may process the signals, and the information contained therein may be displayed for an operator to observe and stored for future processing and reference. Information handling system may also contain an apparatus for supplying control signals and power to downhole fluid sampling tool 100.

In examples, downhole fluid sampling tool 100 may include one or more enhanced probe sections 704. Each enhanced probe section may include a dual probe section 706 or a focus sampling probe section 708. Both of which may extract fluid from the reservoir and deliver said fluid to a channel 710 that extends from one end of downhole fluid sampling tool 100 to the other. Without limitation, dual probe section 706 includes two probes 712, 714 which may extend from downhole fluid sampling tool 100 and press against the inner wall of wellbore 104 (e.g., referring to FIG.

1). Probe channels 716 and 718 may connect probes 712, 714 to channel 710 and allow for continuous fluid flow from the formation 106 to channel 710. A high-volume bidirectional pump 720 may be used to pump fluids from the formation, through probe channels 716, 718 and to channel 710. Alternatively, a low volume pump bi direction piston 722 may be used to remove reservoir fluid from the reservoir and house them for asphaltene measurements, discussed below. Two standoffs or stabilizers 724, 726 hold downhole fluid sampling tool 100 in place as probes 712, 714 press against the wall of wellbore 104. In examples, probes 712, 714 and stabilizers 724, 726 may be retracted when downhole fluid sampling tool 100 may be in motion and probes 712, 714 and stabilizers 724, 726 may be extended to sample the formation fluids at any suitable location in wellbore 104. As illustrated, probes 712, 714 may be replaced, or used in conjunction with, focus sampling probe section 708. Focus sampling prob section 708 may operate and function as discussed above for probes 712, 714 but with a single probe 728. Other probe examples may include, but are not limited to, oval probes, packers, or circumferential probes.

In examples, channel 710 may connect other parts and sections of downhole fluid sampling tool 100 to each other. For example, Additionally, downhole fluid tool 100 may include a second high-volume bidirectional pump 730 for pumping fluid through channel 710 to one or more multi-chamber sections 732, one or more amide side fluid density modules 734, and/or one or more fluid analysis modules 736.

Figure 8:
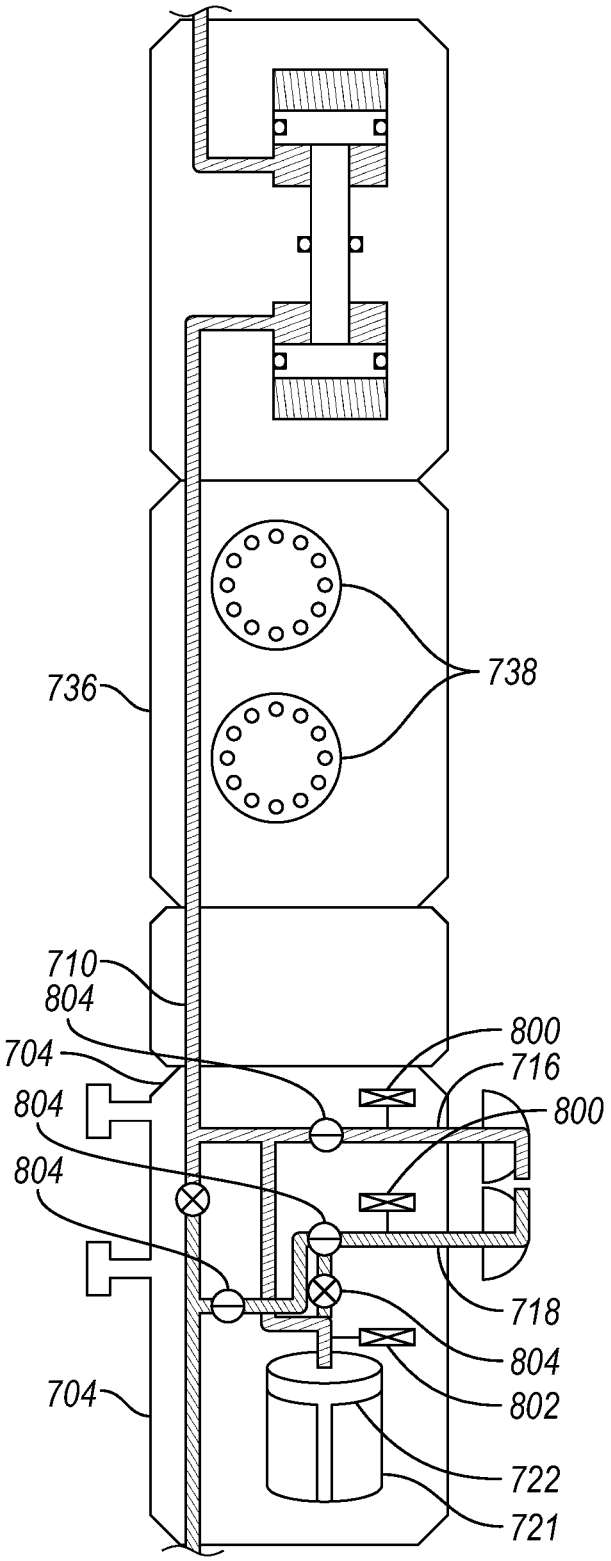
FIG. 8 illustrates an enlarged schematic view of an enhanced probe section.

FIG. 8 illustrates an expanded view of an enhanced probe section 704. As illustrated, enhanced probe section 704 includes low volume pump bi direction piston 722, which is utilized for asphaltene measurements. Asphaltenes are large, high-density hydrocarbons that may be the heaviest component in reservoir fluids. The precipitation and deposition of asphaltenes are a nuisance to any petroleum production system since that may lead to reduction in productivity or injectivity of a well. Asphaltene precipitation and ultimate deposition is caused by a number of factors including changes in pressure, temperature, and composition.

As the reservoir inside formation undergoes primary depletion, the pore (also called reservoir pressure) pressure as well as the flowing bottomhole pressure drops. For a constant temperature, as the decreasing pressure in the reservoir and the wellbore 104 (e.g., referring to FIG. 1) reaches the asphaltene precipitation onset pressure, the dissolved asphaltenes start to precipitate and deposit. This deposition may take place in the reservoir, or near/at the sandface, or in wellbore 104, or in the tubing, or at the surface facilities. This blockage of production paths causes further pressure drops, which results in higher asphaltene precipitation. Over time, this deposition becomes worse until the bubble point pressure is reached. As the pressure falls further below the bubble point, the asphaltene may begin to redissolve into the liquid phase. The deposition of asphaltene may also be caused by changes in fluid composition, and temperature, as well as the introduction of any incompatible chemicals or other fluid production. Identifying when asphaltenes fall out of solution is currently performed by laboratory test. To do this, a reservoir fluid sample is taken by downhole fluid sampling tool 100 and extracted at the surface. From there the reservoir fluid sample is sent to a laboratory for analysis.

Analysis of asphaltenes may be performed with any number of scientific evaluations. A few a listed here for reference. One such operation is the Colloidal Instability Index (CII) that was created to illustrate a scale of eventual asphaltene deposition during production. The CII is made up of SARA fractional components and described by the following equation:

$$CII = \frac{\text{Saturates } \% + \text{Asphaltenes } \%}{\text{Aromatics } \% + \text{Resins } \%} \tag{1}$$

The index is governed by the following criteria:

CII≤0.7: asphaltene fraction stable 0.7≤CII≤0.9: asphaltene fraction uncertain

CII≥0.9: asphaltene fraction unstable

The CII may be utilized with methods below to show pressure indicating stability and instability before and after Asphaltene Onset Pressure (AOP).

Another scientific method to analyze asphaltenes is using a refractive index. A Refractive Index (RI) describes the amount of light bending through a medium. RI is proven to accurately describe fluid properties of a hydrocarbon which may be then applied towards reservoir calculations. The refractive index of oil with respect to a Saturates, Aromatics, Resins and Asphaltenes (SARA) fraction by the following equation:

$$RI_{oil} = .01452 \times (\text{Saturates } \%) + 0.0014982 \times (\text{Asphaltenes } \%) + 0.0016624 \times (\text{Resins } \% + \text{Asphaltenes } \%) \tag{2}$$

At the point of AOP, the RI is described as the Precipitation Refractive Index (PRI). The relation between PRI and $RI_{oil}$ describe a measure that dictates asphaltene stability by the following equation:

$$\Delta(\text{RI}) = \text{RI}_{oil} \times \text{PRI} \tag{3}$$

The index may be governed by the following criteria:

Δ(RI)≤0.045: asphaltene unstable 0.045≤Δ(RI)≤0.060: asphaltene bordering stability Δ(RI)≥0.060: asphaltene stable To describe the solvency of asphaltenes within an oil mixture, the solubility parameter S is a measurement that accounts for molecular forces and energy density of asphaltenes relative to a solution. The Equations below show a relation that describes the solubility parameter of an oil mixture using the oil mixture's refractive index:

$$\delta = 52.042 F_{RI} + 2.904 \tag{4}$$

$$F_{RI} = \frac{(RI^2 - 1)}{(RI^2 + 2)} \tag{5}$$

Where $F_{RI}$ is the function of the refractive index.

At higher temperatures less amount of asphaltene is precipitated. A corollary effect is that the oil is more soluble and stable for asphaltenes. As such, a parameter defined as the "driving force" is established to dictate the force micro-aggregate asphaltenes have over asphaltenes in solution, which is the difference in solubilities as shown in equation:

$$\Delta\delta = \delta_{asph} - \delta_{solution} \tag{6}$$

Another scientific model may be used to find the rate of precipitation for asphaltene. It is assumed proportional to the supersaturation degree of asphaltenes that is defined as the difference between the actual concentration of asphaltenes dissolved in oil and the concentration of asphaltene at equilibrium for a specific temperature and pressure. This rate of precipitation may be described mathematically as:

$$\frac{dC}{dt} = k_p(C_A - C_A^{eq}) \tag{7}$$

where dC/dt is the rate at which the concentration of asphaltene precipitate changes (i.e., the rate at which dissolved asphaltenes precipitate forming micro-aggregates), $k_p$ is the precipitation kinetic parameter, $C_A$ is the actual dissolved concentration of asphaltenes in solution at given operating conditions, and $C_A^{eq}$ is the concentration of asphaltenes in solution at equilibrium for the given temperature and pressure. Yet further, some equation of state models such as PC-SAFT or modified cubic equations of state can predict asphaltene onset pressures as a function of composition and state variables.

As evidenced from Equation 7 above, the precipitation process is modeled as a first order reaction based on the degree of supersaturation of asphaltenes. The higher the concentration difference between the dissolved and equilibrium concentration, the higher the precipitation rate becomes. This concentration difference or the degree of supersaturation in the context of precipitation starts at 0 which is right at the precipitation onset. With decreasing pressure, the equilibrium concentration at the operating conditions goes down as well and therefore the supersaturation degree increases leading to an increase in the rate of precipitation. Gradually, as the dissolved concentration goes down, the rate of precipitation stabilizes before going down again. Since the dissolved concentration of asphaltenes at every point is not known in the system, the differential equation above can be solved to come up with an expression for the rate of precipitation as:

$$\frac{dC}{dt} = k_p(C_0 - C_A^{eq})e^k p^{\Delta t} \tag{8}$$

where $C_0$ is the concentration of dissolved asphaltenes right before the precipitation onset and $\Delta t$ is the incremental time from that point onwards. Equation 8 may then be used to model the rate of precipitation of asphaltene in a reservoir section once the tuning parameter ($k_p$) is sufficiently known.

Experiments and modeling showed that $k_p$ is lower for higher temperatures as well. Therefore, the following relation was derived to relate the kinetic factor, temperature and driving force:

$$k_p = \exp\left(a_0\exp\left(\frac{-a_1}{T}\right) - \frac{b_0\exp\left(\frac{-b_1}{T}\right)}{\Delta\delta}\right) \tag{9}$$

where $a_0$, $b_0$, $a_1$, $b_1$ are constants based on fluid dynamics of asphaltene deposition and T is Temperature. From this, the following independent correlations may be observed:

$$k_p \propto \frac{1}{T},\ k_p \propto \frac{1}{\Delta\delta},\ \text{and}\ \Delta\delta_p \propto \frac{1}{T} \tag{10}$$

As discussed below, a SARA analysis may have a similar effect by destabilizing asphaltenes over time with an increased pressure differential ΔP' from soluble to precipitate. More specifically:

$$\Delta P' = P_{asph} - P_{solution} \tag{11}$$

where $P_{asph}$ are where asphaltene concentrations increase due to precipitation, and $P_{solution}$ is the baseline pressure at which asphaltenes are in solution.

As illustrated in FIG. 8, these laboratory test may be reconstructed downhole using enhanced probe section 704. Specifically, testing methods include the use of housing 721 that includes a low volume bi directional piston 722 within enhanced probe section 704. Housing 721 allows for low volume bi directional piston 722 to draw in fluid for measurement analysis or testing within the housing. When sampling operations are being performed, as described above, formation fluid is extracted from a reservoir through a probe, such as focus sampling probe section 708, and into downhole fluid sampling tool 100 through probe channels 716 and 718. As illustrated, probe channels 716 and 718 may each be connected to independent zero offset quartz pressure gauges 800. In examples, zero offset quartz pressure gauges 800 may be replaced or combined with an optical sensor, a compositional sensor, or a density sensor of which are sensitive to the phase of asphaltenes and or concentration of asphaltenes in a specific phase. Downhole fluid sampling tool 100 includes housing 721 and low volume bi directional piston 722, where housing 721 may have 100 cc of capacity and the capability to operate up to 20000 psi below hydrostatic pressure, which is monitored by another high-resolution pressure gauge 802

During measurement operations, the onset of asphaltenes may be measured utilizing probe section 704 and/or fluid analysis module 736. Within fluid analysis module 736 may be one or more optical measurement tools 738 that are fluidly connected to channel 210. As testing methods are performed with housing 721, additional testing methods may analyze reservoir fluid in channel 210 with one or more optical measurement tools 738 in fluid analysis module 736.

Additionally, probe channels 716 and 718 have the ability to be isolate from internal flowlines, such as channel 710, from the formation through one or more shut in valves 804 positioned along each probe channels 716 and 718. This allows enhanced probe section 704 to access fluids from either only in downhole fluid sampling tool 100 or reservoir fluid taken through a probe.

Figure 9:
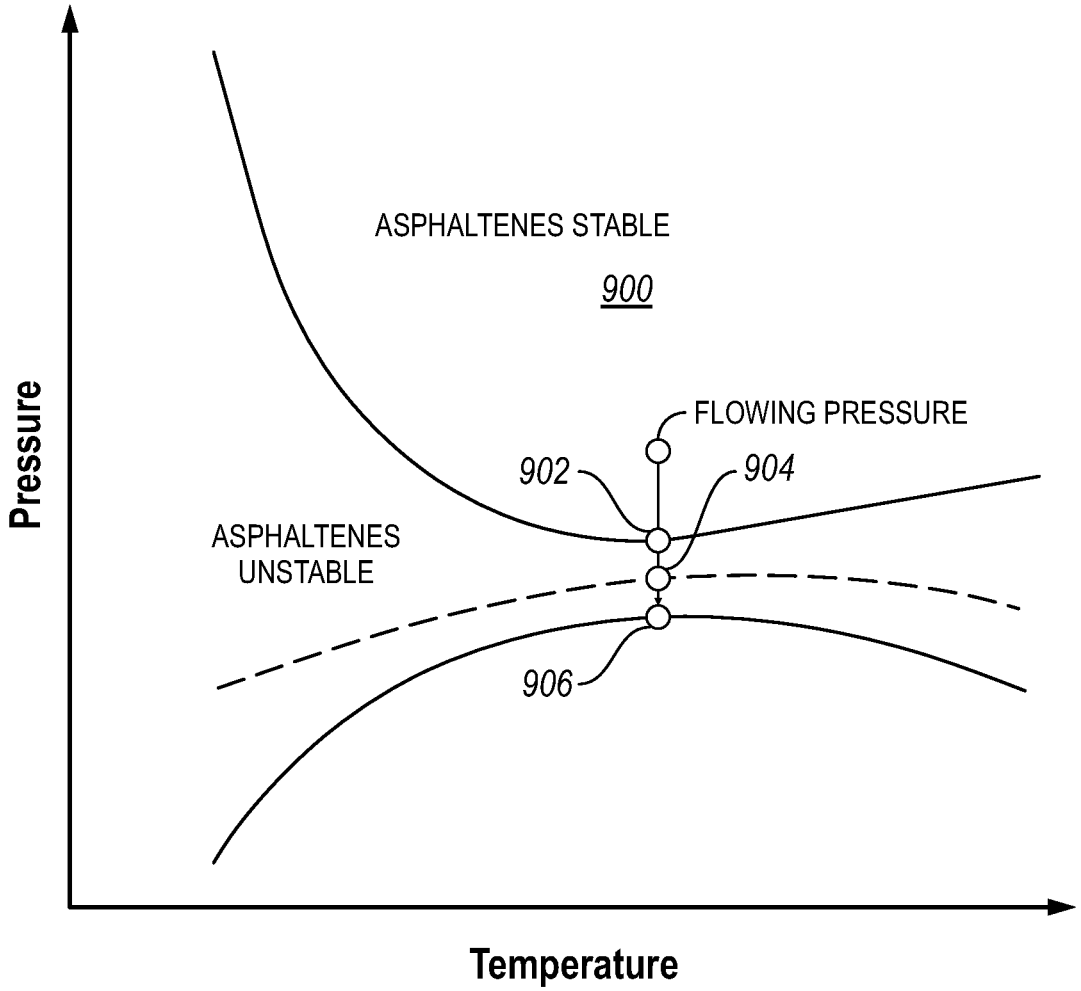
FIG. 9 illustrates a graph illustrating asphaltene phase envelope denoting the stability regions of asphaltenes during production.

FIG. 9 is a graph illustrating asphaltene phase envelope denoting the stability regions of asphaltenes during production. As illustrated, Upper Asphaltene boundary 900 separates asphaltenes in equilibrium denoted "Asphaltene Stable." As a reservoir starts producing (Flowing Pressure) at the sandface, the reservoir eventually depletes and asphaltenes start precipitating at the Upper Asphaltene Onset Pressure (UAOP) 902, where the fluid becomes thermodynamically unstable. As pressure crosses the bubble point (BP) 904, gas evolves from solution and is also near where the peak of asphaltene precipitation exists. The Lower Asphaltene Onset Pressure (LAOP) 906 is the lowest pressure where asphaltenes are out of solution. As the pressure falls further below, the asphaltene begins to redissolve into the liquid and gas phases. This transition is represented with a corresponding increase in asphaltene precipitate from UAOP 902 to the peak at BP 904 and then lowest at the LAOP 906.

Asphaltenes undergo a series of kinetic phases when destabilizing. On precipitation, asphaltene molecules initially evolve out of solution at the UAOP 902, and they reside as visibly suspended particles. With an increase in precipitation, molecules eventually aggregate and combine in the Flocculation process. If flocculated particles are noticed (or predicted) early enough, they may be easily remediated during production, which will lead to a de-aggregation of flocculated particles is known as disassociation. However, if flocculation is left without action, they will lead to deposition. This stage is a considerable threat, where asphaltenes reduce reservoir efficiency by plugging pores in the sandface, depositing on tubing walls, and/or the like. The consequence of not detecting the UAOP 902 early enough may lead to catastrophic consequences and considerable costly remediation efforts. In examples, a Saturates, Aromatics, Resins, Asphaltenes (SARA) analysis may be performed downhole in an effort to identify when Flocculation may begin. This may allow for remediation to be performed to perform de-aggregation of flocculated particles in a disassociation process.

FIGS. 10A-10E illustrate operation of low volume bi directional piston 722, which allows for the downhole measurement and analyze of asphaltenes from reservoir fluid to determine UAOP 902, BP 904, and/or LAOP 906 (e.g., referring to FIG. 9). As SARA analysis may be performed during the operation of bi directional piston 722, which may allow for the identification of Flocculation. This operation may be performed at one or more locations within wellbore 104 (e.g., referring to FIG. 1) and may begin with activating enhanced probe section 704 (e.g., referring to FIG. 7) to allow downhole fluid sampling tool 100 (e.g., referring to FIG. 1) to be in fluid communication with a formation 106 (e.g., referring to FIG. 1) through dual probe section 706 or focus sampling probe section 708 (e.g., referring to FIG. 7), as described above.

Referring back to FIG. 8, measurements taken for a SARA analysis may be performed by zero offset pressure gauges 800 and high-resolution pressure gauge 802 on a fluid sample from formation 106 (e.g., referring to FIG. 1). These measurements may be processed by information handling system 122 (e.g., referring to FIG. 1) to determine asphaltene precipitation during Flocculation. To perform the SARA analysis, probe channels 716 and 718 may be in fluid communication with formation 106, which may allow for a fluid sample to be drawn into housing 721 of downhole fluid sampling tool 100. Isolation of the fluid sample within housing 721 may be performed using one or more shut in valves 804 that may be activated to isolate low volume bi directional piston 722, housing 721, and the fluid sample from other components and devices in downhole fluid sampling tool 100. Using zero offset pressure gauges 800 and high-resolution pressure gauge 802, flowing pressure, temperature, and soluble fluid composition of the fluid sample are measured. These measurements are recorded for a sample point in wellbore 104 in which the fluid sample was retrieved.

Referring back to FIG. 10A, to begin the SARA analysis, low volume bi directional piston 722 is drawn down at a preprogrammed constant rate, while reservoir fluid is drawn into housing 721 by low volume bi directional piston 722 and is monitored in real time. Herein, the reservoir fluid drawn into housing 721 may be referred to as fluid sample. As such, the fluid sample is at a pressure greater than UAOP and the fluid sample will resemble FIG. 10A with asphaltenes saluted within the fluid sample. As low volume bi directional piston 722 continues depressurization within housing 721, the fluid sample within housing 721 may resemble FIG. 10B, as the pressure of the fluid sample is lowered to UAOP. As illustrated, asphaltene particles 1000 start precipitating at the Upper Asphaltene Onset Pressure (UAOP) point within housing 721. Disposed along channel 710 may be at least one fluid analysis sensor (not illustrated). The at least one fluid analysis sensor may observe an inflection sensitive to asphaltenes, particles, or mass changes. Fluid analysis sensors may comprise density sensors, compositional sensors, and other standard operating sensors. For the SARA analysis, the respective pressure and asphaltene concentration are detected by one or more zero offset pressure gauges 800 and/or one or more high-resolution pressure gauges 802. In other embodiments, other components may be measured similar to asphaltene particles 1000, such as, Saturates, Aromatics, Resins, and/or C1-C5%.

Figure 10A:
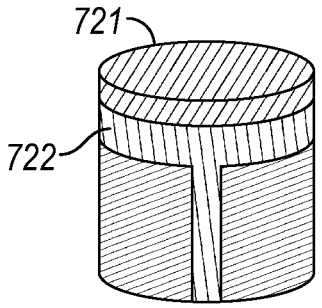
FIGS. 10A-10E illustrate stages of measuring asphaltene precipitation.
Figure 10B:
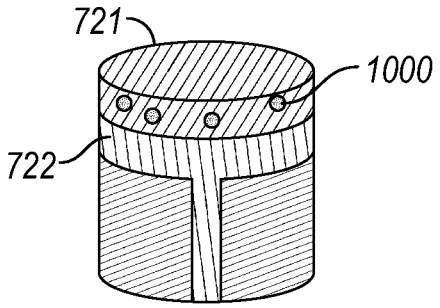
Figure 10C:
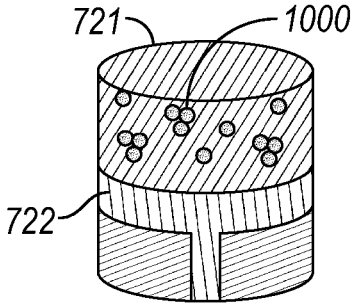
Figure 10D:
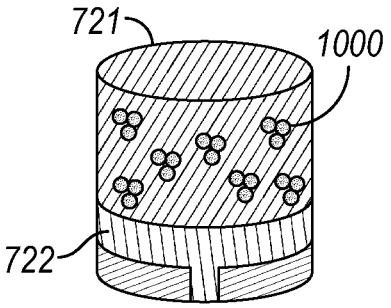
Figure 10E:
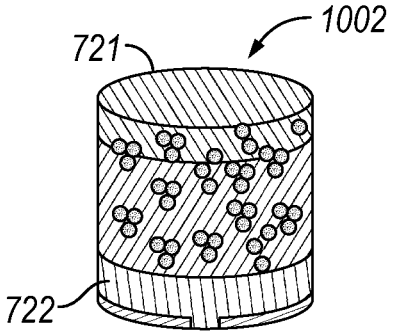

Low volume bi directional piston 722 may further lower the pressure of the fluid sample until it resembles FIG. 10C, in which the fluid sample pressure is equal to the Asphaltene+Resin-Flocculation Onset (ARFO). Evidence of when the fluid sample reaches ARFO may be evident by precipitated asphaltene particles 1000 aggregating and flocculating within the flowline with an inflection in the asphaltene weight percentage. This inflection is detected within housing 721 by fluid analysis sensors as a spike in the first or second derivative. In examples, visually or fitting to a knot curve or other suitable curve may identify such an inflection. Subsequently, pressure of the fluid sample may be lowered as previously described until it resembles FIG. 4D in which the fluid sample pressure is equal to the bubble point (BP), which is shown in all sensor data that is measuring and analyzing asphaltene particles 1000 within housing 721. In addition, further aggregation to asphaltene particles 1000 occurs as part of Flocculation. Finally, pressure of the fluid sample may be lowered as previously described until it resembles FIG. 4E, in which the fluid sample pressure drops below BP. As such, lighter components 1002 liberate from the system and there is a higher concentration of aggregated flocculates of asphaltene particles 1000 in housing 721. At this stage the SARA analysis is concluded by design and should be considered in the planning process. It is not intended to further depressurize the system to the Lower Asphaltene Onset Pressure (LAOP) point. This is due to progression, in which flocculation of asphaltene particles 1000 may transition to deposition, and fluid sampling tool 100 is at risk being plugged and would be inoperable. As a result, no further sampling or pressure tests may be performed, and downhole fluid sampling tool 100 would have to be pulled out to surface for cleaning. During the SARA analysis, the UAOP, ARFO, and BP pressures and temperatures may be identified, as discussed above.

At the end of performing a SARA analysis, low volume bi directional piston 722 is then moved back to the original position within housing 721, compressing the fluid sample in probe channels 712, 716 back to the reservoir flowing pressure. Subsequently, the shut-in valves 804 are opened via power telemetry section 702, equalizing downhole fluid sampling tool 100, and downhole fluid sampling tool 100 may be retracted and moved to another location within wellbore 104 (e.g., referring to FIG. 1) for further SARA analysis. The above sequences are repeated at every sample point, providing AOP, UAOP, LAOP, ARFO and BP measurements and temperatures at unique depths within the reservoir independent of the captured fluid sample. AOP, UAOP, LAOP, ARFO and BP measurements and temperatures may be utilized to form an asphaltene onset pressure map.

Generating an asphaltene onset pressure (AOP) map may begin with identifying one of or any combination of AOP, UAOP, LAOP, ARFO, or BP measurements at one or more depths (i.e., sample points) within wellbore 104 (e.g., referring to FIGS. 1 and 2) during a downhole measurement operation. The AOP map may be formed simply by correlating the AOP measured at various locations to the location or fluid, or rock properties information acquired at the same or similar depths, or modeling may be performed in order to interoperate and extrapolate AOP mapping information. Additionally, other fluid and formation properties at locations both laterally within the field, from analogue wells, and at various depths may be utilized to populate an AOP map. An AOP map may also include reservoir pressure, temperature, density, saturation pressure, production pressure, and/or Equation of State (EOS) properties. Note that the term mapping may be done digitally as a correlation function or other mathematical function that describes the AOP variation relative to the independent properties such as location. Herein location may be defined by depth, lateral extent pressure, temperature, at least one component of reservoir fluid composition. The mapping may take place multidimensionally such that it includes location and geology or compositional information simultaneously and a minimum of two distinct AOP measurements. The map result may be a graphical representation, digital representation, mathematical representation, functional representation, statistical representation, or other appropriate representation that allows information extraction of the AOP per the mapped properties. An AOP map may be formed as a single dimensional variation with depth, or a two-dimensional (2D) topographical style map with lateral location (i.e., north and south). The map may be smooth or jumpy and may also be a contour plot against two dimensions with an AOP, or a color plot on a three-dimensional (3D) surface to demonstrate three dimensions with an AOP. The map may also be a multidimensional matrix of data acquired from downhole formation sampling tool, reservoir parameters, geological parameters, and/or petrophysical parameters.

Using the formed AOP map, a determination may be made whether the reservoir composition is continuous or discontinuous at any vertical depth in which measurements are taken and/or known. For a continuous reservoir, AOP may be smooth as a function of depth or other property that varies smoothly with depth. In contrast, a discontinuous reservoir may have abrupt change in first and or second derivatives in the AOP measurements on the AOP map. A discontinuous reservoir may identify different issues within wellbore 104 (e.g., referring to FIGS. 1 and 2). For examples, discontinuous reservoirs may be produced from gas composition from a gas charge, water washing, biodegradation faulting, baffling, precipitation, convection, and/or the like. A discontinuous reservoir, or disequilibrium, may be remediated to prevent the disequilibrium from effecting production within wellbore 104.

A remediation operation may be designed based at least in part on the AOP map. Generally, remediation operations may be tailored to specific zones as each zone may have different formation properties. The AOP map may further illustrate the known AOP at different zones in a formation 106 (e.g., referring to FIG. 1), wherein two zones are distinguished by different formation properties and are separated by depth. In examples, AOP may vary in each zone by depth according to different sand packages or where different oils exist in a compositional gradient. The AOP map may allow for visualizing precipitation effects in wellbore 104 (e.g., referring to FIG. 1) throughout all zones shown on the AOP map. Thus, each zone on the AOP map may be tailored for different remediation operations. In examples, remediation operations may be chemical treatments that may dissolve asphaltene precipitates. In effective remediation operations, AOP of reservoir fluid will decrease, increasing the production of a zone. Utilization of the AOP map may enable a custom chemical treatment/remediation operation to be designed at specific zones, where AOP values (i.e., disequilibrium) vary according to the AOP map. Remediation operations may be developed for more than one zone. Herein two zones are distinguished by different formation properties and are separated by depth. Thus, personal may be able to perform a remediation operation in two separate zones using two different remediation methods.

In examples, chemicals, for chemical remediation treatments, may be taken downhole by downhole fluid sampling tool 100 (e.g., referring to FIG. 1) to test different chemicals against flocculation at different temperature and pressure to determine which chemical may be superior for chemical remediation at any depth, pressure, and/or temperature. Additionally, downhole sampling tool 100 may be configured to perform a remediation operation within wellbore 104 (e.g., referring to FIG. 1) or to a fluid sample within downhole fluid sampling too 100. To illustrate, after sampling and performing a SARA analysis at a sample point, chemicals be released within downhole fluid sampling tool 100 to test the effectiveness at dissolving asphaltene precipitates at specific pressure and temperature, using the processes described in FIGS. 10A-10D. Results from the test may be used to make a chemical remediation treatment for one or more zones identified on the AOP map. Chemical remediation and/or testing may alter asphaltene onset pressure alteration. The alterations may be utilized to update AOP values on an AOP map. Testing different chemicals downhole for possible chemical remediation processes, while effective, may be expensive.

In other examples, remediation operations may be formed using a Front-End Engineering Design (FEED), which may be cheaper and as effective as testing chemicals downhole, as described above. The FEED may operate and function by utilizing a formed AOP map or a single AOP measurement from a first SARA analysis, an AOP goal, previous general knowledge of oil within formation 106 (e.g., referring to FIG. 1), pressure, temperature, cost, and timeframe. Additionally, FEED remediation operation may be based at least in part on AOP measurements and chemical testing of one or more fluid samples from a laboratory, the downhole fluid sampling tool, and/or remediation from nearby wells. Generally, a FEED remediation operation may allow for the determination of specific combinations of chemicals which may be able to reach an AOP goal for a remediated fluid without physical testing. The inputs described above may be utilized to determine a remediation process that may lower the pressure for which the AOP may occur. Whether utilizing a FEED process or testing chemicals downhole, a suitable remediation process may be identified. The remediation process may then be put into place to fix discontinuous reservoirs such as gas composition from a gas charge, water washing, biodegradation faulting, baffling, precipitation, convection, and/or the like.

After the remediation operation is performed, another SARA analysis is performed on the remediated fluid to determine if the remediation operation was successful. A successful remediation operation will drop the AOP to an acceptable threshold of the AOP goal. Herein, the success of the remediation operation is determined by the difference between the original AOP measurement and the resulting AOP measurement determined in the second SARA analysis and is divided by the difference between the original AOP measurement and the AOP goal. In examples, a successful remediation operation may range from 25-50%, 50%-80%, and 80-99% of the AOP goal. The acceptable threshold is chosen by personnel. Further, if the resulting AOP measurement is lower than the AOP goal, the remediation operation was successful.

Currently, remediation operations are determined within a lab. For example, an AOP map may be formed from measurements taken in a lab and chemical treatments performed in the lab. A SARA analysis may then be performed to determine possible remediation operations. However, laboratory measurements and analysis cannot replicate the ever-changing downhole environments. The methods and systems discussed above are an improvement over current technology. Specifically, the methods and systems utilized above may form a remediation operation by performing a SARA analysis downhole to determine one or more AOP measurements at a plurality of locations within a wellbore. The AOP measurements may be utilized to form a AOP map that may be used to identify possible remediation operations. Those remediation operations may be verified downhole utilizing downhole fluid sampling tool 100. Additionally, a FEED may be utilized to further narrow down possible remediation operations in a shorter amount of time.

The systems and methods may include any of the various features disclosed herein, including one or more of the following statements.

Statement 1: A method may comprise disposing a downhole fluid sampling tool into a wellbore, taking a first fluid sample with the downhole fluid sampling tool at a first depth, performing a first Saturates, Aromatics, Resins, Asphaltenes (SARA) analysis on the first fluid sample, and developing a first remediation operation based at least in part on the first SARA analysis. The method may further comprise performing the first remediation operation on the first fluid sample to form a first remediated fluid sample and performing a second SARA analysis on the first remediated fluid sample.

Statement 2: The method of statement 1, wherein a Front-End Engineering Design (FEED) identifies one or more chemicals for the first remediation operation.

Statement 3: The method of statement 2, wherein the FEED is based at least in part on an AOP goal.

Statement 4: The method of statement 3, wherein the AOP goal comprises a threshold.

Statement 5: The method of statement 4, further comprising determining if the first remediation operation is above the threshold by comparing the first SARA analysis to the second SARA analysis.

Statement 6. The method of statement 5, further comprising updating the first remediation operation if the first remediation operation is not above the threshold.

Statement 7. The method of statements 1 or 2, wherein the downhole fluid sampling tool performs the first remediation operation.

Statement 8. The method of any preceding statements 1, 2 or 7, further comprising taking a second fluid sample with the downhole fluid sampling tool at a second depth, wherein the first depth and the second depth are in different zones.

Statement 9. The method of statement 8, further comprising performing a third SARA analysis on the second fluid sample.

Statement 10. The method of statement 9, further comprising developing a second remediation operation based at least in part on the third SARA analysis and performing the second remediation operation on the second fluid sample to form a second remediated fluid sample.

Statement 11. The method of statement 10, wherein the first remediation operation and the second remediation operation comprise different chemical compositions.

Statement 12. The method of statement 11, further comprising performing a fourth SARA analysis on the second remediated fluid sample.

Statement 13. A system may comprise a downhole fluid sampling tool that may comprise one or more probes configured to take at least one fluid sample from the wellbore. The system may further comprise an information handling system that may be configured to perform a first Saturates, Aromatics, Resins, Asphaltenes (SARA) analysis on the at least one fluid sample and develop a remediation operation based at least in part on the first SARA analysis.

Statement 14. The system of statement 13, wherein the downhole fluid sampling tool is configured to transport one or more chemicals for the remediation operation.

Statement 15. The system of statement 14, wherein the downhole fluid sampling tool further performs the remediation operations on the at least one fluid sample to form a remediated fluid sample.

Statement 16. The system of statement 15, wherein the information handling system is further configured to perform a second SARA analysis on the first remediated fluid sample.

Statement 17. The system of statement 14, wherein the information handling system is further configured to perform a Front-End Engineering Design (FEED) to identify one or more chemicals utilized for the remediation operation and the FEED is based at least in part on an AOP goal.

Statement 18. The system of statement 17, wherein the AOP goal comprises a threshold.

Statement 19. The system of statement 18, wherein the information handling system further configured to determine if the first remediation operation is above the threshold by comparing the first SARA analysis to a second SARA analysis.

Statement 20. The system of statement 19, wherein the information handling system is further configured to update the first remediation operation if the first remediation operation is not above the threshold.

The preceding description provides various embodiments of the systems and methods of use disclosed herein which may contain different method steps and alternative combinations of components. It should be understood that, although individual embodiments may be discussed herein, the present disclosure covers all combinations of the disclosed embodiments, including, without limitation, the different component combinations, method step combinations, and properties of the system. It should be understood that the compositions and methods are described in terms of "including," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only and may be modified and practiced in different but equivalent manners apparent to those skilled in the art having the benefit of the teachings herein. Although individual embodiments are discussed, the disclosure covers all combinations of all of the embodiments. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of those embodiments. If there is any conflict in the usages of a word or term in this specification and one or more patent(s) or other documents that may be incorporated herein by reference, the definitions that are consistent with this specification should be adopted.

What is claimed is:

1. A method comprising:

disposing a downhole fluid sampling tool into a wellbore;

taking a first fluid sample with the downhole fluid sampling tool at a first depth;

performing a first Saturates, Aromatics, Resins, Asphaltenes (SARA) analysis on the first fluid sample;

developing a first remediation operation based at least in part on the first SARA analysis;

performing the first remediation operation on the first fluid sample to form a first remediated fluid sample; and performing a second SARA analysis on the first remediated fluid sample.

2. The method of claim 1, wherein a Front-End Engineering Design (FEED) identifies one or more chemicals for the first remediation operation.

3. The method of claim 2, wherein the FEED is based at least in part on an AOP goal.

4. The method of claim 3, wherein the AOP goal comprises a threshold.

5. The method of claim 4, further comprising determining if the first remediation operation is above the threshold by comparing the first SARA analysis to the second SARA analysis.

6. The method of claim 5, further comprising updating the first remediation operation if the first remediation operation is not above the threshold.

7. The method of claim 1, wherein the downhole fluid sampling tool performs the first remediation operation.

8. The method of claim 1, further comprising taking a second fluid sample with the downhole fluid sampling tool at a second depth, wherein the first depth and the second depth are in different zones.

9. The method of claim 8, further comprising performing a third SARA analysis on the second fluid sample.

10. The method of claim 9, further comprising developing a second remediation operation based at least in part on the third SARA analysis and performing the second remediation operation on the second fluid sample to form a second remediated fluid sample.

11. The method of claim 10, wherein the first remediation operation and the second remediation operation comprise different chemical compositions.

12. The method of claim 11, further comprising performing a fourth SARA analysis on the second remediated fluid sample.

13. A system comprising: a downhole fluid sampling tool comprising: one or more probes configured to take at least one fluid sample from a wellbore; and an information handling system configured to: perform a first Saturates, Aromatics, Resins, Asphaltenes (SARA) analysis on the at least one fluid sample; and develop a remediation operation based at least in part on the first SARA analysis.

14. The system of claim 13, wherein the downhole fluid sampling tool is configured to transport one or more chemicals for the remediation operation.

15. The system of claim 14, wherein the downhole fluid sampling tool further performs the remediation operations on the at least one fluid sample to form a remediated fluid sample.

16. The system of claim 15, wherein the information handling system is further configured to perform a second SARA analysis on the first remediated fluid sample.

17. The system of claim 14, wherein the information handling system is further configured to perform a Front-End Engineering Design (FEED) to identify one or more chemicals utilized for the remediation operation and the FEED is based at least in part on an AOP goal.

18. The system of claim 17, wherein the AOP goal comprises a threshold.

19. The system of claim 18, wherein the information handling system further configured to determine if the first remediation operation is above the threshold by comparing the first SARA analysis to a second SARA analysis.

20. The system of claim 19, wherein the information handling system is further configured to update the first remediation operation if the first remediation operation is not above the threshold.

* * * * *